US005293842A

United States Patent [19]

Loesel

[11] Patent Number: 5,293,842

[45] Date of Patent: Mar. 15, 1994

[54] METHOD FOR OPERATING A SYSTEM FOR STEAM GENERATION, AND STEAM GENERATOR SYSTEM

[75] Inventor: Georg Loesel, Uttenreuth, Fed. Rep. of Germany

[73] Assignee: Siemens Aktiengesellschaft, Munich, Fed. Rep. of Germany

[21] Appl. No.: 33,152

[22] Filed: Mar. 16, 1993

[30] Foreign Application Priority Data

Mar. 16, 1992 [DE] Fed. Rep. of Germany ..... 4208397

[51] Int. Cl.[5] ..... F22D 1/00

[52] U.S. Cl. ..... 122/7 R; 122/1 C; 122/421; 122/422

[58] Field of Search ..... 122/7 R, 420, 421, 422 1 C

[56] References Cited

U.S. PATENT DOCUMENTS 4,489,679 12/1984 Holt ..... 122/421 X
4,617,878 10/1986 Paguet ..... 122/422
4,693,213 9/1987 Yanai et al. ..... 122/7 R
4,858,562 8/1989 Arakawa et al. ..... 122/7 R

*Primary Examiner*—Edward G. Favors
*Attorney, Agent, or Firm*—Herbert L. Lerner; Laurence A. Greenberg

[57] ABSTRACT

A method for operating a system for steam generation includes generating steam from water by indirect heat exchange with hot flue gas, by first preheating condensed water and then evaporating the preheated water at high pressure. The method further includes cooling the preheated water which is already at high pressure, by heat exchange with at least one partial flow of the condensed water, at least in a partial-load range. A system for steam generation, such as in a gas and steam turbine plant, includes a steam generator through which hot flue gas flows. The steam generator has heating surfaces. One of the heating surfaces is a condensate preheater having primary and secondary sides. A heat exchanger is connected downstream of the condensate preheater on the primary side and is connected upstream of the condensate preheater on the secondary side.

8 Claims, 1 Drawing Sheet

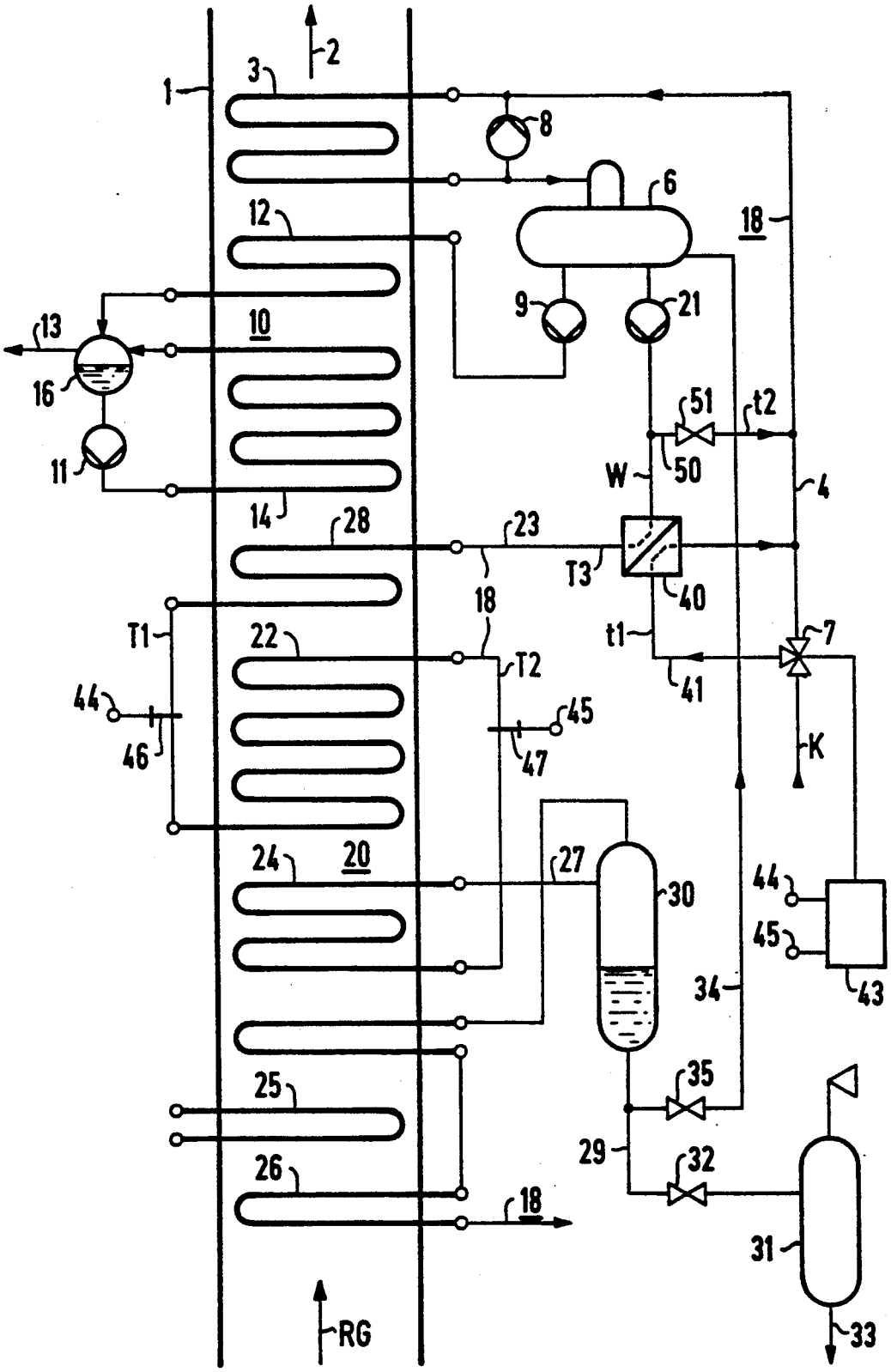
1
2
3
8
6
18
12
9
21
13
10
16
51
t2
11
W
50
4
14
28
23
T3
40
18
T1
22
t1
7
T2
41
44
45
46
47
K
24
20
27
30
44
45
43
34
35
25
29
32
26
18
31
RG
33

METHOD FOR OPERATING A SYSTEM FOR STEAM GENERATION, AND STEAM GENERATOR SYSTEM

The invention relates to a method for operating a system for steam generation, particularly in a fossil-fueled power plant, such as a gas and steam turbine system, in which steam is generated from water by indirect heat exchange with hot flue gas, condensed water is first preheated, and then the preheated water is evaporated at high pressure. The invention also relates to a system operated by the method.

In a system for steam generation, the quantity of heat in the steam generator contained in a hot flue gas, is utilized to generate steam. By way of example, the flue gas may be a hot exhaust flowing from a gas turbine, and the steam generator may be a waste heat boiler connected downstream of the gas turbine. The heating surfaces, which are disposed in the steam generator and are constructed as tubes or bundles of tubes, are typically connected into the water-steam loop of a steam turbine. The water-steam loop often includes a plurality of pressure stages, each being made up of a preheater, an evaporator, and a superheater. In order for the largest possible proportion of the heat quantity contained in the flue gas to be converted, a condensate preheater is also provided in the steam generator, for heating the condensed water from the steam turbine. Especially low temperatures of the exhaust gas leaving the steam generator are attained if the flue gas enters the steam generator at a high temperature and if the total quantity of water available in the water-steam loop is high. That means that in full-load operation, the efficiency of the system is especially high. That is especially applicable if the steam generator is operated with auxiliary equipment.

However, during operation of such a system, the quantity of heat introduced into the steam generator varies under different operating conditions, and the heating surfaces in the steam generator are constructed for full-load operation. In the partial-load range, or in other words in the range below full-load operation of the system, the quantity of heat introduced into the steam generator is lowered by reducing the flue gas temperature, even if the mass flow of the flue gas remains virtually constant. The resultant decrease in the quantity of steam being generated results in a reduction in the total water quantity available in the water-steam loop. That can undesirably lead to premature evaporation of the preheated, high-pressure water. That kind of steam development in a high-pressure preheater (economizer), or at its outlet, has a particularly deleterious effect on the mass distribution at the inlet to the typically parallel tubes in the high-pressure evaporator of the steam generator. An unstable flow in the tubes, especially in the tubes of the high-pressure evaporator, above all decreases the effectiveness of the heating surfaces and thus makes the system less efficient. Unstable flow conditions can also cause damage to the heating surfaces.

It is accordingly an object of the invention to provide a method for operating a system for steam generation and a steam generation system, which overcome the hereinafore-mentioned disadvantages of the heretofore-known methods and devices of this general type and which do so in such a way that the highest possible efficiency and stable flow conditions in the region of the heating surfaces are attained in all operating states, including the partial-load range in particular.

With the foregoing and other objects in view there is provided, in accordance with the invention, in a method for operating a system for steam generation, which includes generating steam from water by indirect heat exchange with hot flue gas, by first preheating condensed water and then evaporating the preheated water at high pressure, the improvement which comprises cooling the preheated water which is already at high pressure, by heat exchange with at least one partial flow of the condensed water, at least in a partial-load range.

In accordance with another mode of the invention, there is provided a method which comprises ascertaining the temperature of the water prior to the evaporation and the temperature of the steam, and adjusting the partial stream by using the difference between the temperatures as a variable. This in turn affects the temperature of the preheated water, which is at high pressure.

In accordance with a further mode of the invention, there is provided a method which comprises admixing a partial stream of the preheated, high-pressure water with the condensed water. This is done in order to adjust the temperature of the condensed water before it enters the steam generator.

With the objects of the invention in view, there is also provided a system for steam generation, comprising a steam generator through which hot flue gas flows, the steam generator having heating surfaces, one of the heating surfaces being a condensate preheater having primary and secondary sides, and a heat exchanger being connected downstream of the condensate preheater on the primary side and being connected upstream of the condensate preheater on the secondary side.

In accordance with another feature of the invention, another of the heating surfaces is a high-pressure evaporator having inflow and outflow sides, and there are provided temperature sensors each being disposed at a respective one of the inflow and outflow sides of the high-pressure evaporator, a condensate line, a valve incorporated into the condensate line, and a regulator being connected to the temperature sensors and to the valve. This is done in order to adjust the temperature of the preheated, high-pressure water flowing through the heat exchanger on the primary side.

In accordance with a further feature of the invention, the heat exchanger is disposed in a partial stream line that is a bypass around the condensate line.

In a fossil-fueled steam generator, in particular a Benson steam generator, it is known to follow the actual high-pressure evaporator with a further evaporator, in other words a so-called residual evaporator or presuperheater. The location or point of complete evaporation, beyond which the superheating of the steam begins, is located inside the residual evaporator. If the corresponding evaporator or heating surface tubes and the associated connecting tubes are disposed symmetrically, and if there is sufficiently high turbulence in a collecting container preceding the corresponding tubes, good distribution of the water-steam mixture is attained at the inlet of the tubes of the residual evaporator. Heretofore, the residual evaporator was disposed downstream of the first high-pressure evaporator, in terms of the direction of flow of the hot flue gas and was accordingly in a region having a comparatively cool flue gas temperature.

In accordance with a concomitant feature of the invention, the residual evaporator is disposed upstream of the actual high-pressure evaporator, as seen in flow direction of the flue gas, and the high-pressure evaporator is connected upstream of the residual evaporator within the water-steam loop and is connected downstream of the condensate preheater. Connecting the elements in this way makes for reliable adherence to the specified interval between the temperature of the flue gas in the steam generator in the region of the outlet of the high-pressure evaporator and that of the saturated steam in the high-pressure evaporator. To a considerable extent, this temperature interval, which is also known as a "pinch point", determines the size of the heating surface area of the high-pressure evaporator. With this configuration of heating surfaces, it is thus possible to achieve an especially small heating surface area of the high-pressure evaporator and the residual evaporator, especially under stable flow conditions.

Other features which are considered as characteristic for the invention are set forth in the appended claims.

Although the invention is illustrated and described herein as embodied in a method for operating a system for steam generation and a steam generation system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing.

The drawing is a schematic circuit diagram of a portion of a system for steam generation, with a steam generator having heating surfaces which are connected into a water-steam loop.

Referring now to the single FIGURE of the drawing in detail, there is seen a system for steam generation which includes a steam generator 1, through which hot flue gas RG flows on a primary side. The steam generator 1 may be part of a gas and steam turbine system, for example. As is indicated by an arrow 2, the cooled flue gas RG leaves the steam generator 1 in the direction of a non-illustrated smokestack. The flue gas RG is generated in the steam generator itself which, for instance, may be fossil-fueled. Alternatively, the flue gas may be the hot exhaust from a gas turbine connected upstream of the steam generator 1. In that case, the steam generator 1 is also known as a waste heat boiler or a waste heat steam generator.

The steam generator 1 includes a condensate preheater 3, a low-pressure heater 10, a high-pressure heater 20, and an intermediate superheater 25.

The low-pressure heater 10 includes a preheater 12 and an evaporator 14, which together with a water-steam drum 16 and a low-pressure part of a non-illustrated steam turbine, are part of a low-pressure stage of a water-steam loop 18.

The high-pressure heater 20 includes two series-connected evaporators 22, 24 and a high-pressure superheater 26, which together with a high-pressure preheater or economizer 28 and a water-steam tank 30, as well as a high-pressure part of the non-illustrated steam turbine, form a high-pressure stage of the water-steam loop 18.

The intermediate superheater 25 is connected to a medium-pressure part of the steam turbine in a non-illustrated manner.

When the system is in operation, condensed water K flows out of a non-illustrated condenser connected downstream of the non-illustrated steam turbine, through a condensate line 4 and through the condensate preheater 3, into a feed water tank 6. A three-way valve 7 is connected into the condensate line 4. In order to adjust a suitable feed water temperature, some of the condensed water K, which is preheated in the condensate preheater 3, is pumped through the condensate preheater 3 again by a recirculating pump 8.

Water flows from the feedwater tank 6, through a feedwater pump 9 into the low-pressure preheater 12, and from there into the water-steam drum 16. In the water-steam or separating drum 16, water and steam are separated from one another. The water is carried by a pump 11 through the low-pressure evaporator 14, and from there it is pumped back, in the form of steam, into the separating drum 16. The steam is delivered to the low-pressure part of the steam turbine through a line 13.

Preheated water W is also drawn from the feedwater tank 6 by a high-pressure pump 21, and it is pumped at high pressure into the economizer 28 through a line 23. From the economizer, the preheated, high-pressure water W flows into the evaporators 22 and 24. The steam flowing out of the evaporator 24, which can also be called a residual evaporator or presuperheater, is pumped through a line 27 into the water-steam separating tank 30.

When the system is put into operation, the economizer 28 and the evaporators 22 and 24 are first supplied with a predetermined stream of water. The water is collected in the water-steam separating tank 30 and from there it is discharged into a flash tank or expansion tank 31 through a line 29. A valve 32 is incorporated into the line 29. The water is discharged from the flash tank 31 at atmospheric pressure through a line 33.

As the heating surfaces of the steam generator 1 are increasingly heated by the flue gas RG, the steam production and the pressure in the separating tank 30 both rise. At the same time, the quantity of water occurring there becomes less. The water occurring in the separating tank 30 is then pumped entirely or partially back into the feedwater tank 6 through a line 34 into which a valve 35 is incorporated. Once the heating and the quantity of water are at the specified equilibrium, then no further water occurs in the separating tank 30.

In partial-load operation of the system, the preheated and high-pressure water W, flowing to the economizer 28 and the evaporators 22 and 24, is cooled by heat exchange with the condensed water K, or at least a partial stream $t_1$ of the condensed water K. To that end, a heat exchanger 40 has one end located in the line 23 and another end located in a partial stream line 41 of the condensate line 4. The partial stream line 41 thus communicates with the condensate line 4 both on its inlet side, through the three-way valve 7, and on its outlet side. Accordingly, the heat exchanger 40 is connected downstream of the condensate preheater 3 on the primary side and upstream of the condensate preheater 3 on the secondary side.

The partial stream $t_1$ of the condensed water K is regulated in order to adjust the temperature T3 of the preheated water W, which is at high pressure. To that end, the three-way valve 7 is connected to a regulator 43. The regulator 43 is connected through terminals 44 and 45 to respective temperature sensors 46 and 47. The temperature T1 of the water entering the evaporator 22 is ascertained with the temperature sensor 46. The temperature T2 of the steam or water-steam mixture flowing out of the evaporator 22 is ascertained with the temperature sensor 47. The difference between these two temperatures T1 and T2 which is ascertained in the regulator 43, serves as a control variable for adjusting the three-way valve 7 and therefore the partial stream $t_1$. In this process care is taken to adjust the temperature T3 of the preheated water W, which is at high pressure, in such a way that it is only slightly, but reliably, below the boiling temperature when the water enters the evaporator 22.

In order to attain additional heating of the condensed water K, an adjustable partial stream $t_2$ of the preheated, high-pressure water W is admixed with this condensed water. To that end, a line 50 that communicates with the condensate line 4 is connected to the outlet side of the high-pressure pump 21. A valve 51 is incorporated into the line 50.

As a result of the heat exchange between the preheated, high-pressure water W and the partial stream $t_1$ of the condensed water K inside the heat exchanger 40, a uniform distribution of flow at the inlet to the evaporator 22 is attained even in the partial-load range of the system. This in turn has a particularly advantageous affect on the total efficiency of the system.

The heating surfaces of the steam generator 1 are typically each constructed as bundles of tubes having a number of individual tubes. In order to make it possible to build the steam generator 1 on site in a simple way from individual modules, the tubes of the individual heating surfaces discharge on both their inlet and their outlet sides into collecting tanks, which are represented in the drawing by circles at the inlets and outlets of the heating surfaces. When the steam generator 1 is assembled and when the entire system is erected, the collecting tanks are made to communicate with one another through connecting tubes, in accordance with the particular circuitry specified, and are connected into the water-steam loop 18. This makes it possible to assemble various modules with different heating surface areas, as needed.

I claim:

1. In a method for operating a system for steam generation, which includes generating steam from water by indirect heat exchange with hot flue gas, by first preheating condensed water and then evaporating the preheated water at high pressure, the improvement which comprises cooling the preheated water which is already at high pressure, by heat exchange with at least one partial flow of the condensed water, at least in a partial-load range.

2. The method according to claim 1, which comprises ascertaining the temperature of the preheated water prior to the evaporation and the temperature of the steam, and adjusting the partial stream by using the difference between the temperatures as a variable.

3. The method according to claim 1, which comprises admixing a partial stream of the preheated, high-pressure water with the condensed water.

4. A system for steam generation, comprising a steam generator through which hot flue gas flows, said steam generator having heating surfaces, one of said heating surfaces being a condensate preheater, and a heat exchanger having primary and secondary sides, said primary side of said heat exchanger being connected downstream of said condensate preheater and the secondary side of said heat exchanger being connected upstream of said condensate preheater.

5. The system according to claim 4, wherein another of said heating surfaces is a high-pressure evaporator having inflow and outflow sides, and including temperature sensors each being disposed at a respective one of the inflow and outflow sides of said high-pressure evaporator, a condensate line, a valve incorporated into said condensate line, and a regulator being connected to said temperature sensors and to said valve.

6. The system according to claim 5, including a further evaporator connected downstream of said high-pressure heat exchanger, said further evaporator being disposed upstream of said high-pressure evaporator in said steam generator, as seen in flow direction of the flue gas.

7. The system according to claim 5, including a partial stream line being a bypass around said condensate line, said heat exchanger being disposed on the secondary side in said partial stream line.

8. A gas and steam turbine plant, comprising a system for steam generation including a steam generator through which hot flue gas flows, said steam generator having heating surfaces, one of said heating surfaces being a condensate preheater, and a heat exchanger having primary and secondary sides, the primary side of said heat exchanger being connected downstream of said condensate preheater and the secondary side of said heat exchanger being connected upstream of said condensate preheater.

* * * * *